United States Patent [19]

Reuter

[11] Patent Number: 5,035,405

[45] Date of Patent: Jul. 30, 1991

[54] APPARATUS FOR ANNEALING AND QUENCHING

[75] Inventor: Wolfgang Reuter, Niddatal, Fed. Rep. of Germany

[73] Assignee: Leybold Aktiengesellschaft, Fed. Rep. of Germany

[21] Appl. No.: 566,764

[22] Filed: Aug. 14, 1990

Related U.S. Application Data

[62] Division of Ser. No. 377,133, Jul. 10, 1989, Pat. No. 4,992,112.

[30] Foreign Application Priority Data

Dec. 30, 1988 [DE] Fed. Rep. of Germany ..... 3844272

[51] Int. Cl.[5] ..... C21D 9/00

[52] U.S. Cl. ..... 266/250

[58] Field of Search ..... 266/250

[56] References Cited

U.S. PATENT DOCUMENTS 4,647,017 3/1987 Stainbrook ..... 266/250

FOREIGN PATENT DOCUMENTS 1805351 5/1970 Fed. Rep. of Germany .
1942801 5/1970 Fed. Rep. of Germany .
2113287 9/1972 Fed. Rep. of Germany .

*Primary Examiner*—Melvin J. Andrews

*Attorney, Agent, or Firm*—Hill, Van Santen, Steadman & Simpson

[57] ABSTRACT

Annealing and quenching method and apparatus for the implementation of the method. An annealing and quenching method for materials or parts referred to as a charge that is finish-annealed in a vacuum annealing plant and that then proceeds into a sluice chamber fashioned a full-pipe. An intermediate deposit of the charge occurs in this sluice chamber. After the intermediate deposit, a first sluice valve that is located between the chamber for the annealing furnace and the sluice chamber is closed. A second sluice valve that is located between the sluice chamber and a quenching container is subsequently opened. Movable brackets for the intermediate deposit of the charge are retracted, so that the charge falls through the second sluice valve into a quenching medium in the quenching container. It can be additionally provided that the pressure differential between the sluice chamber that is under a vacuum before the second sluice valve is opened and the quenching container is utilized before the dropping of the charge. Due to the pressure differential, quenching medium is suctioned out of the quenching container into the sluice chamber when the second sluice valve is opened. The medium comes into contact with the charge. A two-stage quenching process is advantageously achieved. The time from finished annealing up to the cooling bath and the fall path is considerably shortened.

12 Claims, 1 Drawing Sheet

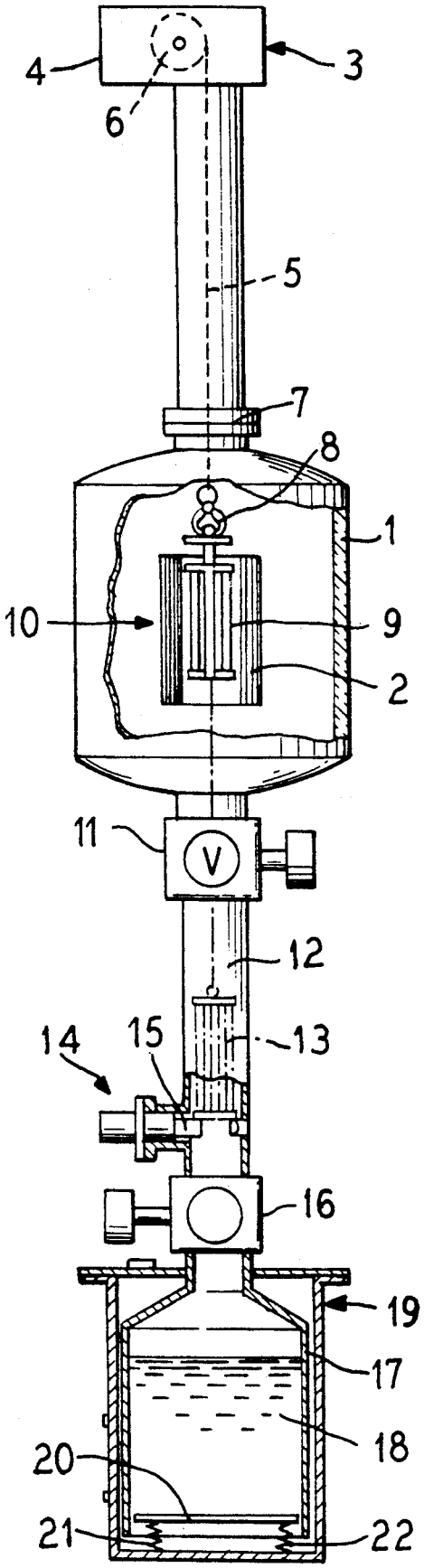
4
3
6
5
7
8
1
10
9
2
11
V
12
14
15
13
16
19
17
18
20
21
22

APPARATUS FOR ANNEALING AND QUENCHING

This is a division of application Ser. No. 377,133, filed 07/10/89, now U.S. Pat. No. 4,922,112.

BACKGROUND OF THE INVENTION

The present invention is directed to an apparatus utilizing an annealing and quenching method for materials or parts composed of materials, particularly for metals or parts composed of metals or for ceramic or parts composed of ceramic (hereinafter referred to as a charge), that are annealed in a vacuum annealing plant or protective atmosphere annealing plant (annealing system or annealing furnace) and are subsequently quenched in a quenching system, whereby the charge is moved by a conveyor system, particularly by a cableway.

Vacuum processing technology and protective atmosphere processing technology have a number of methods for annealing and quenching materials and parts. For these methods and for the systems for the implementation of the methods in the prior art, it is generally a drawback that the time from the finished annealing up to the time of the cooling bath is too long. In systems of the prior art that operate with a fall path for the charge, they are considered disadvantageous in that the fall path is too long.

SUMMARY OF THE INVENTION

The present invention provides the following objects:

Disadvantages of the prior art are avoided, in particular, the time span between finished annealing and quenching or the fall path is shortened.

In the prior art, the charge was allowed to fall into the quenching medium. Included among the objects of the present invention is to provide a method in addition to the method of allowing the charge to fall wherein the falling of the charge can be eliminated, damage to thin-walled and filigree parts during quenching being thereby avoided.

The present invention establishes the conditions that the suction effect resulting from the opening of the sluice chamber that is under a vacuum can be advantageously utilized for the gentle quenching of, in particular, thin-walled and filigree parts.

The stated objects are achieved in that a conveyor system lowers the charge into the heating zone of the annealing system wherein the charge is heated, that the charge proceeds through a first sluice valve into a sluice chamber by means of the conveying system and is placed in position, that a gripper element of the conveying system releases the charge and is retracted from the sluice chamber through the first sluice valve, that the chamber of the annealing system is closed off from the sluice chamber by the first sluice valve, that a second sluice valve arranged between the sluice chamber and the quenching container is opened, that quenching medium is suctioned out of the quenching container into the sluice chamber as a result of the pressure differential between the sluice chamber and the quenching container thereby quenching the charge positioned in the sluice chamber.

It can be alternatively provided that a holding mechanism in the sluice chamber releases the charge that is then conveyed into the quenching medium in the quenching container by force of gravity.

A combination of the two methods set forth above advantageously leads to a two-stage quenching method. In this combination the quenching medium is suctioned out of the quenching container into the sluice chamber as a result of the pressure differential between the sluice chamber and the quenching container and quenches the charge positioned in the sluice chamber in a first quenching process. The holding mechanism provided for the positioning of the charge in the sluice chamber releases the charge that is then conveyed into the quenching medium in the quenching container by the force of gravity and the change is quenched in a second quenching process.

For the implementation of the described methods, the sluice chamber is vertically or approximately vertically positioned or is equipped with an axis that has a vertical directional component and is constructed such that the charge is conveyed into the quenching container under the action of the force of gravity. In particular, it can be provided that the sluice chamber is at least partially fashioned as a fall-pipe.

In order to achieve a suction effect between sluice chamber and the quenching container, the pressure level in the sluice chamber that is lower in comparison to the quenching container before the quenching process is utilized.

In one exemplary embodiment of the present invention, a holding mechanism for positioning the charge, particularly for an intermediate deposit of the charge, is provided in the sluice chamber. The holding mechanism is composed of one or more movable brackets that can be moved into the sluice chamber.

For releasing the charge positioned in the sluice chamber, the conveying system fashioned as a cable winch is provided with a gripper element fashioned as a semi-automatic forceps. For damping the impact of the charge falling into the quenching container, the floor of the quenching container is provided with a collecting element, particularly a spill plate, that is preferably seated on damping elements.

The stated objects are achieved with the present invention. An extremely short time from finished annealing to quenching is achieved with the methods of the present invention and with the systems for the implementation of these methods. In comparison to the prior art, the drop height for the charge is reduced, with cost-effective, structural measures. As shown, the present invention makes a two-stage quenching possible, that is quenching by a quenching medium that has been suctioned into the sluice chamber and subsequent dropping of the charge into the quenching medium.

In addition an advantage of the present invention is that the dropping of the charge into the quenching medium can be completely omitted. Thin-walled and filigree parts can be quenched in this fashion without the risk that these parts will be damaged. Compared to the prior art, the subject matter of the present invention reduces the complexity for controlling and regulating the system.

BRIEF DESCRIPTION OF THE DRAWING

The features of the present invention which are believed to be novel, are set forth with particularity in the appended claims. The invention, together with the further objects and advantages, may best be understood by reference to the following description taken in conjunction with the accompanying drawing, in which:

The single FIGURE shows a schematic cross-sectional view partially broken away of a system for the implementation of an annealing and quenching process of the present invention.

DESCRIPTION OF THE PREFERRED EMBODIMENT

The present invention has general applicability but is most advantageously utilized in a system as depicted in the single FIGURE.

A vacuum chamber 1 for an annealing furnace 10 accommodates a heater 2 that can be a resistance heater or an induction heater. A conveyor system 3 is situated above the chamber 1 for the annealing furnace 10. The conveyor system 3 has a housing 4 that surrounds a cable winch. The cable winch is essentially composed of a cable 5 and a cable pulley 6. The housing 4 of the conveyor system 3 is connected to the chamber 1 of the annealing furnace 10 with a flange connection 7. A semi-automatic gripper forceps 8 is located at the lower end of the cable 5. The forceps 8 encompasses the upper end of a charge 9.

The charge 9 first proceeds into the annealing furnace 10. A first sluice valve 11 is located under the chamber 1 for the annealing furnace 10, this first sluice valve 11 closing or opening the chamber 1 of the annealing furnace 10 from a sluice chamber 12.

The charge 7 is lowered through the first sluice valve 11 with the cable winch 3 and the semi-automatic grippe forceps 8 and deposited onto movable brackets 15 within the evacuated sluice chamber 12. The gripper forceps 8 is subsequently raised and the first sluice valve 11 is closed.

The sluice chamber 12 is fashioned as a fall-pipe. Reference numeral 13 references the charge in its lower position within the fall-pipe. It is supported on a retaining mechanism 14 that serves as an intermediate deposit for the charge 13. The retaining mechanism 14 has one or more brackets 15 that simultaneously form the support for the charge. When the brackets, one being referenced 15 in the FIGURE, are retracted, then the charge 13 falls through the previously opened, second sluice valve 16 into the quenching container 17 which is under atmospheric pressure and which is filled with the quenching medium 18. By opening the second sluice valve 16, the pressure differential between the sluice chamber 12 and quenching container 17 is eliminated. The suction effect that results is utilized, as shall be set forth below.

In the present exemplary embodiment, the quenching medium 18 can be water or oil. However, other quenching mediums can also be used.

The quenching container 17 is located inside the container 19. A spill plate 20 is resiliently seated by means of damping elements 21, 22. The impact of charges or charge parts is damped by the spill plate 20.

A description of the methods employed is as follows:

The charge 9 (which may be a material or parts) is lowered into the annealing furnace 10 by the conveyor system 3 and is subsequently finish-annealed therein. After the conclusion of the annealing process, the first sluice valve 11 is opened and the second sluice valve 16 is closed. A vacuum exists in the chamber 1 of the annealing furnace and in the sluice chamber 12.

The charge is lowered farther with the cable winch of the conveyor system 3 and proceeds through the first sluice valve 11 into the sluice chamber or fall-pipe 12. The charge is intermediately seated on the brackets 15 in the fall-pipe 12.

As shown, the cable winch 3 is provided with a semi-automatic forceps 8. The charge is released by the forceps 8 so that it is positioned as charge 13 in the FIGURE. The forceps 8 is then retracted through the first sluice valve 11. The first sluice valve 11 is closed and the second sluice valve 16 is opened. A pressure equalization then occurs between the sluice chamber 12 and the quenching container 17.

Three methods can now be used.

According to the first method, the brackets 15 are retracted so that the support for the charge 13 is eliminated. The charge 13 falls through the second sluice valve 16 into the quenching medium 18 in the quenching container 17.

In the second method, the charge, proceeds into the position of charge 13 within the sluice chamber 12. The first sluice valve 11 is closed and the second sluice valve 16 is opened. Before the second sluice valve 16 is opened, the sluice chamber 12, as set forth above, is in its evacuated condition. However, the quenching container 17 is under atmospheric pressure. Due to the pressure equalization, quenching medium 18 is now suctioned through the second sluice valve 16 into the sluice chamber 12. The quenching medium 18 comes into contact with the charge 13 and the charge is quenched. This second method is excellently suited for quenching thin-walled parts in that a dropping of the charge 13 can be eliminated.

The third method is composed of a combination of the first and second methods. The third method uses the suction effect as a first method step. A second method step is the retraction of the brackets 15 and the dropping of the charge 13 into the quenching medium 18. Thus with the third method a two-stage quenching method can be advantageously implemented.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An annealing and quenching apparatus for annealing a charge in a vacuum or protective atmosphere annealing system and for subsequently quenching the charge in a quenching system, the charge being moved by a conveyor system from the annealing system to the quenching system, the apparatus comprising: a first chamber having a means for heating the charge; a sluice chamber for at least intermediate storage of the charge, said sluice chamber located below said first chamber; a quenching container, said quenching container located below said sluice chamber; a first sluice valve connecting said first chamber to said sluice chamber; a second sluice valve connecting said sluice chamber to said quenching container; a gripper element on the conveyor system for releasable holding the charge in the first chamber and in the sluice chamber; wherein in a method for using the apparatus the charge is lowered into the first chamber by the conveyor system and heated therein; wherein the charge is moved by the conveyor system through the first sluice valve and into the sluice chamber, and positioned therein; wherein the gripper element is retracted from the sluice chamber through the first sluice valve after the charge is released; wherein after closing the first sluice valve to close the first chamber relative to the sluice chamber, the second sluice valve is open, thereby quenching the charge.

2. The apparatus according to claim 1, wherein the apparatus further comprises a holding mechanism for at least temporarily positioning the charge in the sluice chamber and wherein, in the method for using the apparatus after the second sluice valve located between the sluice chamber and the quenching container is opened, the holding mechanism releases the charge which is then conveyed into the quenching medium in the quenching container by the force of gravity, or after the second sluice valve is opened, the quenching medium is suctioned out of the quenching container into the sluice chamber as a consequence of the pressure differential between the sluice chamber and the quenching container to quench the charge positioned in the sluice chamber in a first quenching process, the holding mechanism releases the charge which is then conveyed into the quenching medium in the quenching container by the force of gravity and is quenched therein in a second quenching process, or after the second sluice valve is opened, the holding mechanism holds the charge in the sluice chamber whereby the quenching medium is suctioned out of the quenching chamber and into the sluice chamber as a consequence of a pressure differential between the sluice chamber and the quenching chamber, thereby quenching the charge in the sluice chamber.

3. The apparatus according to claim 1, wherein the sluice chamber is oriented at least approximately vertically and is fashioned such that the charge is conveyed into the quenching container by the force of gravity.

4. The apparatus according to claim 1, wherein the sluice chamber is at least partially fashioned as a fall-pipe.

5. The apparatus according to claim 1, wherein a holding mechanism for positioning the charge is provided in the sluice chamber.

6. The apparatus according to claim 5, wherein the holding mechanism is composed of one or more movable brackets that can be moved into the sluice chamber.

7. The apparatus according to claim 1, wherein the conveyor system is fashioned as a cable winch and wherein the gripper element is fashioned as a semi-automatic forceps.

8. The apparatus according to claim 1, wherein the floor of the quenching container is provided with a collecting element that is seated on damping elements.

9. An annealing and quenching apparatus for a charge, the charge being annealed in an annealing system and being subsequently quenched in a quenching system, the apparatus comprising: a substantially vertical conveyor system for moving the charge from an annealing system to a quenching system, the quenching system being located substantially directly below the annealing system; a first chamber in the annealing system, the first chamber having a means for heating the charge; a sluice chamber for at least intermediate storage of the charge, said sluice chamber located below said first chamber; a quenching container, said quenching container located below said sluice chamber; a first sluice valve connecting said first chamber to said sluice chamber; a second sluice valve connecting said sluice chamber to said quenching container; a gripper element on the conveyor system for releasable holding the charge in the first chamber and in the sluice chamber; a holding mechanism for positioning the charge in the sluice chamber; wherein in a method for using the apparatus the charge is lowered into the first chamber by the conveyor system and heated therein; wherein the charge is lowered by the conveyor system through the first sluice valve and into the sluice chamber in the quenching system, and the charge is positioned therein by the holding mechanism; wherein the gripper element on the conveyor system releases the charge, thereafter the gripper element being raised from the sluice chamber through the first sluice valve; wherein after closing the first sluice valve to close the first chamber of the annealing system relative to the sluice chamber, the second sluice valve is opened thereby suctioning quenching medium out of the quenching container and into the sluice chamber as a consequence of a pressure differential between the sluice chamber and the quenching container, the charge positioned in the sluice chamber thereby being quenched in a first quenching operation, and, after the first quenching operation, the holding mechanism releasing the charge which then falls into the quenching medium in the quenching container by the force of gravity and which is quenched therein in a second quenching operation, or the second sluice valve is opened and the holding mechanism releases the charge which then falls into the quenching medium in the quenching container by the force of gravity and which is quenched therein, or the second sluice valve is opened thereby suctioning the quenching medium out of the quenching container and into the sluice chamber as a consequence of a pressure differential between the sluice chamber and the quenching container, the charge positioned in the sluice chamber thereby being quenched, the holding mechanism holding the charge in the sluice chamber.

10. The apparatus according to claim 9, wherein the holding mechanism is composed of one or more movable brackets that can be moved into the sluice chamber.

11. The apparatus according to claim 9, wherein the conveyor system is fashioned as a cable winch and wherein the gripper element is fashioned as a semi-automatic forceps.

12. The apparatus according to claim 9, wherein the floor of the quenching container is provided with a collecting element that is seated on damping elements.

* * * * *